US005893995A

United States Patent [19]

Waters

[11] Patent Number: 5,893,995

[45] Date of Patent: Apr. 13, 1999

[54] REFRIGERANT BOTTLE WARMER

[76] Inventor: Steve W. Waters, 2215 Polk St., Wichita Falls, Tex. 76309

[21] Appl. No.: 08/848,830

[22] Filed: May 5, 1997

[51] Int. Cl.[6] ..... F27D 7/04; B67D 5/63

[52] U.S. Cl. ..... 219/400; 62/292; 222/146.3; 222/146.5

[58] Field of Search ..... 219/385, 386, 219/400, 401; 99/474–476; 62/292, 77; 392/365; 222/146.1–146.5

[56] References Cited

U.S. PATENT DOCUMENTS

| | | | |
|---|---|---|---|
| Re. 23,709 | 9/1953 | Page . | |
| 2,453,425 | 11/1948 | Freed . | |
| 2,691,090 | 10/1954 | Vischer, Jr. . | |
| 3,586,516 | 6/1971 | Terc . | |
| 3,780,794 | 12/1973 | Staub . | |
| 3,904,086 | 9/1975 | Losenno | 222/146.5 |
| 5,367,888 | 11/1994 | Muston et al. | 62/292 |
| 5,588,353 | 12/1996 | Glucksman et al. | 99/475 |
| 5,704,278 | 1/1998 | Cross | 126/21 A |

FOREIGN PATENT DOCUMENTS

| | | |
|---|---|---|
| 484237 | 5/1938 | United Kingdom . |

*Primary Examiner*—Mark H. Paschall
*Assistant Examiner*—J. Pelham
*Attorney, Agent, or Firm*—Stephen R. Greiner

[57] ABSTRACT

An apparatus for warming a bottle of refrigerant so as to elevate the pressure within the bottle and increase the rate of refrigerant flow through an open discharge valve. The apparatus includes a housing having a cradle positioned therein for receiving the bottle and spacing same from the walls of the housing to ensure proper air circulation through the interior space. A lid removably covers an opening in the housing and has a central aperture for the passage of the valve stem of the bottle. The lid also has an air intake vent and an air exhaust vent adjacent the central aperture. An air flow passageway connects the air intake vent with the air exhaust vent for circulating air to and from the interior space of the housing. An electrical resistance heater and an electric blower are positioned within the passageway. The blower impels air through the passageway from the air intake vent to the air exhaust vent and past the heater. A thermostat, positioned in the housing, deenergizes the heater when the air within the interior space reaches a predetermined temperature.

17 Claims, 2 Drawing Sheets

REFRIGERANT BOTTLE WARMER

FIELD OF THE INVENTION

The present invention relates generally to electrical heating devices and, in particular, to a device utilizing a heated air stream directed at the exterior of a container such as a refrigerant bottle to elevate the internal temperature thereof.

BACKGROUND OF THE INVENTION

In the refrigeration cycle, a refrigerant is mechanically compressed, cooled and then expanded. Compression raises the temperature of the refrigerant above that of its surroundings so that it can give up its heat in a heat exchanger to a heat sink such as air. In expanding, the temperature of the refrigerant is lowered and it absorbs heat from its surroundings which may comprise all or part of a building to provide refrigeration. After the refrigerant absorbs heat, the cycle is repeated.

Mechanical refrigeration systems are, unfortunately, not leakproof and require the periodic addition of refrigerant. This refrigerant must be one which will easily expand and vaporize at low pressure to a gas and return to a liquid at ordinary temperatures by compression. Some common refrigerants are ammonia, carbon dioxide and a group known by the trade name Freon. These refrigerants are typically supplied to a refrigeration system through a supply hose extending from a pressurized storage bottle.

As refrigerant passes through the supply hose from the storage bottle, the pressure of the refrigeration system increases thereby reducing the rate of refrigerant flow from the bottle. On a cool day, when the pressure of the bottle contents is lowered by environmental conditions, the refrigerant flow rate is reduced even further. Regardless of the conditions, much time can be lost waiting for a refrigeration system to be recharged. A need, therefore, exists for a device which will safely increase the rate of refrigerant flow from a storage bottle during refrigeration system recharging operations.

SUMMARY OF THE INVENTION

In light of the problems associated with emptying a bottle of refrigerant into a pressurized refrigeration system, it is a principal object of the invention to provide means for safely warming a bottle of compressed refrigerant. By warming the bottle and its contents, the vapor pressure of the refrigerant is elevated thereby increasing the rate of at which refrigerant flow may flow from the bottle when its discharge valve is opened.

Briefly, the warming apparatus in accordance with this invention achieves the principal object by featuring a housing having an interior space for receiving a refrigerant bottle and an opening for entry to the interior space. A lid, having a central aperture for passage of the valve stem of the refrigerant bottle, covers the opening in the housing. The lid also has an air intake vent and an air exhaust vent adjacent the central aperture. An air flow passageway connects the air intake vent with the air exhaust vent. An electrical resistance heater and a motor-driven fan blade are positioned within the passageway.

When rotated, the fan blade draws relatively cool air from the interior space of the housing through the intake vent and past the heater. Air warmed by the heater is subsequently discharged from the exhaust vent into the interior space of the housing to warm the refrigerant bottle. Since the electrical resistance heater is not in direct contact with the refrigerant bottle, the possibility of overheating the refrigerant bottle is reduced.

To further reduce the potential for overheating, the invention also features a thermostat and a manual switch for deenergizing the electrical resistance heater. The thermostat is positioned in the housing to sense the temperature of the air within the interior space and automatically deenergize the electrical resistance heater and fan motor when the sensed temperature of the air within the interior space reaches a predetermined threshold. The switch, however, is secured to the lid for manually opening the electrical circuit to the electrical resistance heater and the electric motor.

Additionally, the invention features a cradle removably positioned within the interior space of the housing. The cradle holds the refrigerant bottle away from the side and bottom walls of the housing so that air can be easily circulated through the interior space of the housing and around the refrigerant bottle. Thus, even heating of the refrigerant bottle and its contents can be ensured.

The inventive apparatus features handles on the sides of the housing for easily grasping and transporting such. If desired, a refrigerant bottle may be stored, transported and used without removal from the apparatus with the housing, lid and cradle thereof serving as a protective, "second skin."

It is an object of the invention to provide improved elements and arrangements thereof in an apparatus for the purposes described which is lightweight in construction, inexpensive in manufacture, and fully effective in use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
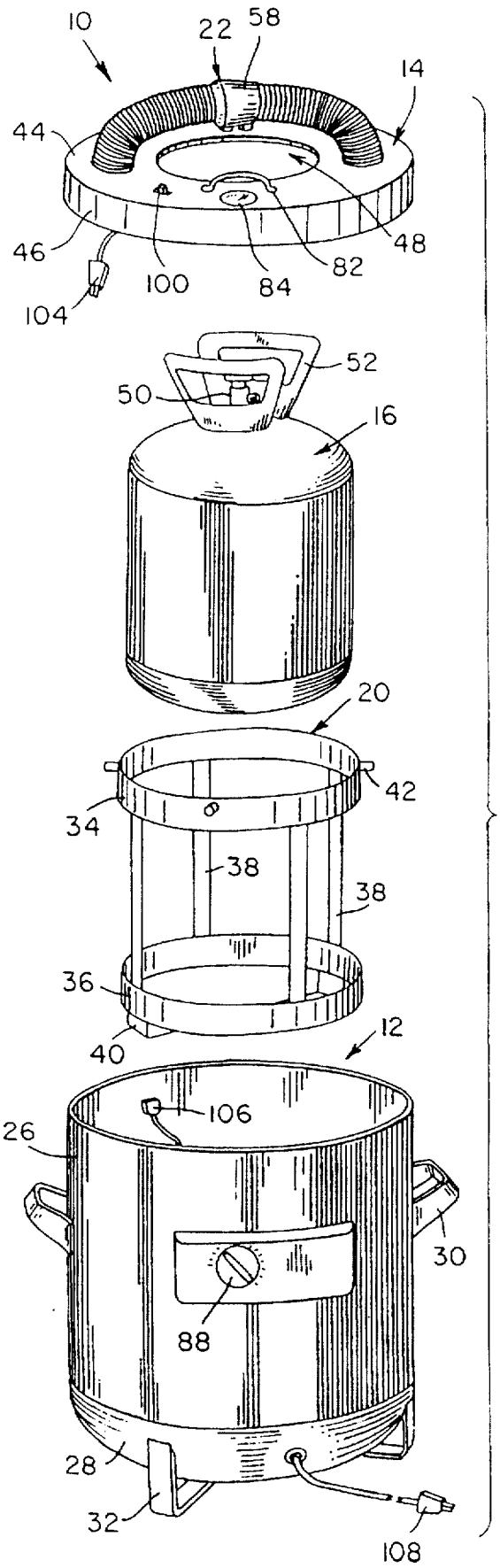
FIG. 1 is an exploded perspective view of a refrigerant bottle warmer in accordance with the present invention.
Figure 2:
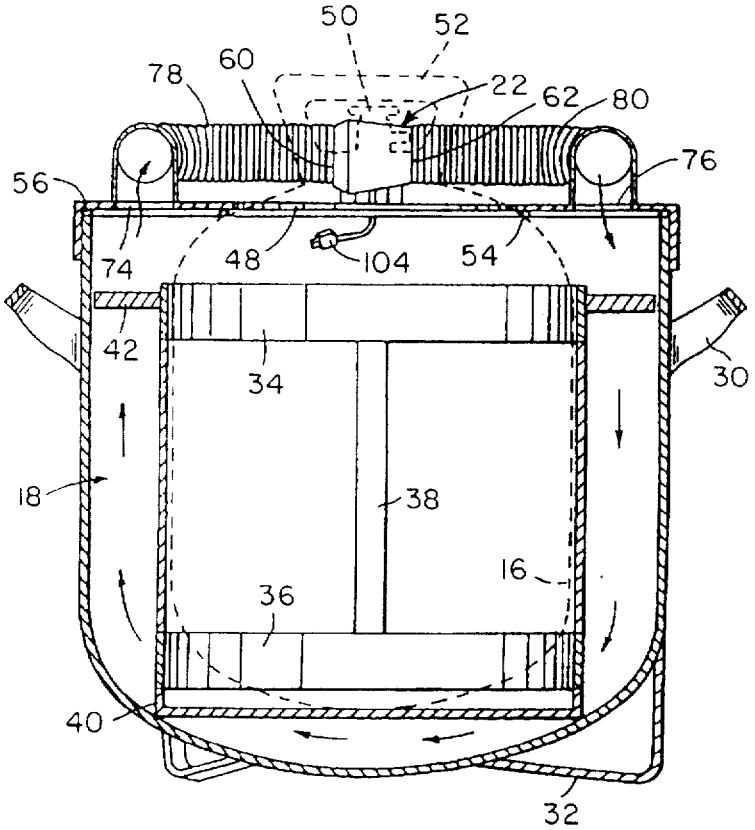
FIG. 2 is a vertical, sectional view of the refrigerant bottle warmer.

Referring now to the FIGS., a refrigerant bottle warmer in accordance with the present invention is shown at 10. The warmer 10 includes a housing 12 having an open top adapted to be covered by a removable lid 14. The interior of the housing 12 is sized to receive a conventional refrigerant bottle 16. An annular space 18 is maintained between the bottle 16 and the housing 12 by a bottle-supporting cradle 20. Secured to the lid 14 is a heater/blower unit 22 for driving warmed air into the annular space 18 to elevate the internal temperature of the bottle 16. An electrical control circuit 24 regulates the operation of the heater/blower unit 22.

The housing 12 preferably includes a cylindrical side wall 26 extending upwardly from an integral bottom wall 28 having a bowl-like shape. A pair of handles 30 are secured, opposite one another, to the side wall 26 so that the warmer 10 may be easily lifted and transported by a user. A plurality of legs 32 are secured around the periphery of the bottom wall 28 to maintain the warmer 10 in an upright position when placed on a support.

The cradle 20 is removably positioned within the housing 12. As illustrated, the cradle 20 has a pair of vertically-spaced rings 34 and 36 with a diameter sized to closely receive the bottle 16. The rings 34 and 36 are connected together by a plurality of columns 38. To the opposite sides of the lower ring 36 are secured the opposed ends of a U-shaped platform member 40 which, during use, holds the bottom of the bottle 16 above the bottom wall 28 of the housing 12. A plurality of radially disposed fingers 42 are secured around the periphery of the upper ring 34 to centrally locate the upper ring 34 within the cylindrical side wall 26.

The lid 14 includes a circular cover plate 44 having a peripheral rim or lip 46 adapted to fit over the top of housing side wall 26. A central opening 48 is provided in the cover plate 44 to permit access to the valve stem 50 and upstanding handles 52 of the refrigerant bottle 16. To seal the lid 14 against the refrigerant bottle 16, a rubber gasket 54 is secured around the opening 48. A similar gasket 56 is secured around the periphery of the cover plate 44 to seal the lid 14 against the housing 12.

Mounted atop the cover plate 44 of the lid 14 is the heater/blower unit 22 which may be easily serviced by removing and replacing the unit when necessary. The heater/blower unit 22 comprises a cylindrical, air flow chamber 58 having an inlet 60 and an outlet 62 at its opposed ends. Positioned within the chamber 58, adjacent the outlet 62, are a pair of electrical resistance heating coils 64 and 66 shown schematically in FIG. 3. Positioned within the chamber 58 adjacent the inlet 60, on the other hand, is an electric motor 68 having a rotatable shaft 70. Secured to the shaft 70 is a fan blade 72 adapted to blow air through the chamber 58 and over the heating coils 64 and 66.

The inlet 60 and outlet 62 of the air flow chamber 58 are connected, respectively, to vents 74 and 76 in opposite sides of the lid cover plate 44 by means of conduits 78 and 80. As shown, the conduit 78 is connected at one of its ends to the inlet 60 and connected at the other of its ends to the vent 74. Likewise, the conduit 80 is connected at one of its ends to the outlet 62 and connected at the other of its ends to the vent 76. Each of the vents 74 and 76 is vertically aligned with a portion of the annular space 18 delineated within the housing 12.

Opposite the heater/blower unit 22 on the lid cover plate 44 is secured a handle 82 so that the lid 14 may be easily grasped and moved. Adjacent the handle 82, a temperature gauge 84, having a probe (not shown) disposed within the housing 12, is secured to the lid cover plate 44. The gauge 84 provides a user with a visual indication of the air temperature within the housing 12.

The heater/blower unit 22 is connected in a circuit 24 with a double-break type switch 86 and a thermostat 88 which serves to operate the unit 22 at two power settings. The switch 86 is preferably mounted on the cover plate 44 of the lid 14 for easy access by a user. The thermostat 88 is preferably mounted on the side wall 26 of the housing 12.

While the switch 86 may take any suitable form known in the art, for the purposes of illustration the switch has been shown to comprise a number of stationary contacts 90, 92, 94 and 96. A movable contact member 98 is operatively associated with the stationary contacts 90, 92, 94 and 96 and is adapted to be moved from one operating position to another by means of a manually-operable slide 100 extending upwardly from the cover plate 44.

Figure 3:
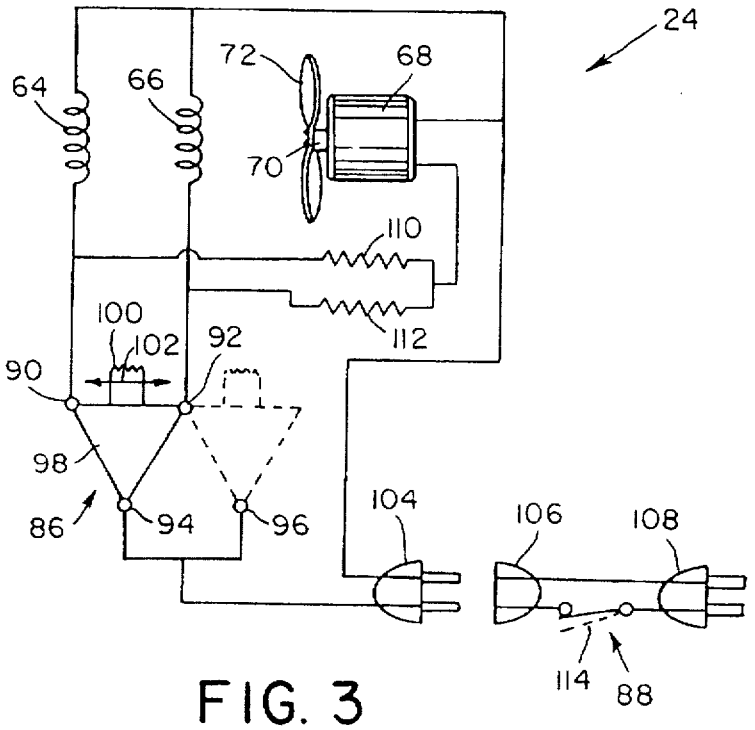
FIG. 3 is a schematic wiring diagram of the electrical circuit of the refrigerant bottle warmer.

The slide 100 is mounted for selective lateral movement as indicated by the arrow 102. Therefore, when the slide 100 is moved to the "low" power setting, the movable contact member 98 is moved from the solid line position to the dashed line position, as shown in FIG. 3, to complete an electrical circuit between stationary contacts 92 and 96. Similarly, when the slide 100 is moved back to the "high" power setting indicated by the solid line position indicated in FIG. 3, the movable contact member 98 completes an electrical circuit between contacts 90, 92 and 94. When the slide 100 is moved to bring the movable contact member 98 to a medial position between the "high" and "low" settings indicated in FIG. 3, no electrical current can flow between the movable contact member and stationary contacts 90, 92, 94 and 96 thus breaking the circuit 24.

The stationary contacts 94 and 96 in the switch 86 are both connected to the thermostat 88 by means of electrical connectors 104 and 106. The thermostat 88 is of the type well known in the art for regulating temperature by turning a source of heat, such as heating coils 64 and 66, on and off. As shown, the thermostat 88 may returned to one terminal of an electrical current source such as a conventional wall outlet by electrical connector 108.

The stationary contact 90 of the switch 86 is connected with heating coil 64, resistor 110 and motor 68. The stationary contact 92 of the switch 86, however, is connected with the heating coil 66, resistor 112 (having a relatively lower resistance than that of resistor 110) and motor 68. Thus, with the thermostat 88 closed as shown by the solid line position of FIG. 3, movement of the slide to the "high" setting will energize both of the heating coils 64 and 66 and the motor 68 to circulate air warmed to about 120 degrees fahrenheit at a high rate of flow through the annulus 18. Alternatively, movement of the slide 98 to the "low" power setting will energize only the heating coil 66 and the motor 68 to circulate air warmed to about 100 degrees fahrenheit at a low rate of flow through the annulus 18.

The warmer may be deenergized in a number of ways. First, manually positioning the slide 100 of the switch 86 between the indicated "high" and "low" settings so that the movable contact member 98 is spaced from the stationary contacts 90, 92, 94 and 96 will prevent current flow to the heater/blower unit 22. Second, should the temperature of the air being circulated through the housing reach a predetermined threshold, the thermostat 88 will break an internal electrical contact 114 opening the circuit 24 to shut off the flow of electrical current to the heater/blower unit 22. (Of course, when the air temperature within the housing 12 drops below the predetermined threshold, the electrical contact 114 of the thermostat will close to reenergize the heater/blower unit 22 provided that the switch 86 is set on "high" or "low.") Finally, the warmer may be disconnected from the power source by disengaging the electrical connector or plug 108 from a wall socket.

While the invention has been described with a high degree of particularity, it will be appreciated by those skilled in the art that many modifications thereto. For example, rather than mounting the heater/blower unit 22 on top of the lid 14 as illustrated hereinabove, the lid 14 or a portion of the housing 12 could be provided with an internal cavity and the heater/blower unit could be secured within this cavity. Therefore, it is to be understood that the present invention is not limited to the sole embodiment described above, but encompasses any and all embodiments within the scope of the following claims.

I claim:

1. An apparatus for warming a refrigerant bottle having a valve stem extending therefrom, said apparatus comprising:

a housing having an interior space adapted to receive the refrigerant bottle and an opening providing access to said interior space;

a lid removably covering said opening in said housing, said lid having a central aperture for the passage of the valve stem of the refrigerant bottle, said lid also having an air intake vent and an air exhaust vent adjacent said central aperture;

an air flow passageway connecting said air intake vent with said air exhaust vent for circulating air to and from said interior space of said housing;

an electrical resistance heater positioned within said air flow passageway;

a fan blade positioned within said air flow passageway adjacent said electrical resistance heater;

an electric motor having a rotatable shaft connected to said fan blade for rotating same so as to impel air through said passageway from said air intake vent to said air exhaust vent and past said electrical resistance heater; and, an electrical circuit for energizing said electrical resistance heater and said electric motor.

2. The apparatus according to claim 1 wherein said electric motor and said fan blade are located in said air flow passageway.

3. The apparatus according to claim 1 wherein said air flow passageway is in fluid communication with said interior space of said housing at said air intake vent and said air exhaust vent.

4. The apparatus according to claim 3 further comprising a cradle positioned within said interior space of said housing for receiving the refrigerant bottle therein and spacing the refrigerant bottle from the walls of said housing in order to facilitate air circulation through said interior space.

5. The apparatus according to claim 1 wherein said cradle comprises:

a pair of vertically-spaced rings sized to snugly receive the refrigerant bottle therein;

a plurality of columns connecting said vertically-spaced rings together;

a platform member secured to the lower one of said vertically-spaced rings for supporting the refrigerant bottle at a fixed height above the bottom of said interior space of said housing; and, a plurality of fingers extending outwardly from the upper one of said vertically-spaced rings for spacing the upper one of said vertically-spaced rings from the walls of said housing.

6. The apparatus according to claim 1 further comprising a thermostat positioned in said housing for deenergizing said electrical resistance heater when the air within said interior space reaches a predetermined temperature.

7. The apparatus according to claim 1 further comprising a switch for manually opening said electrical circuit to said electrical resistance heater and said electric motor.

8. The apparatus according to claim 1 further comprising a first sealing element secured around the periphery of said central aperture in said lid adapted to engage the refrigerant bottle and prevent the loss of heated air through said central aperture.

9. The apparatus according to claim 1 further comprising a second sealing element secured around the periphery of said lid for engaging said housing and preventing the loss of heated air through said opening in said housing.

10. An apparatus for warming a refrigerant bottle having a valve stem extending therefrom, said apparatus comprising:

a housing having an interior space adapted to receive the refrigerant bottle and an opening providing access to said interior space;

a cradle positioned within said interior space of said housing for receiving the refrigerant bottle therein and spacing the refrigerant bottle from the walls of said housing in order to facilitate air circulation through said interior space;

a lid removably covering said opening in said housing, said lid having a central aperture for the passage of the valve stem of the refrigerant bottle, said lid also having an air intake vent and an air exhaust vent adjacent said central aperture;

an air flow passageway connecting said air intake vent with said air exhaust vent for circulating air to and from said interior space of said housing;

an electrical resistance heater positioned within said air flow passageway;

a fan blade positioned within said air flow passageway adjacent said electrical resistance heater;

an electric motor having a rotatable shaft connected to said fan blade for rotating same so as to impel air through said passageway from said air intake vent to said air exhaust vent and past said electrical resistance heater;

a thermostat positioned in said housing for deenergizing said electrical resistance heater when the air within said interior space reaches a predetermined temperature; and, an electrical circuit connecting said electrical resistance heater, said electric motor and said thermostat with a power source.

11. The apparatus according to claim 10 wherein said electric motor and said fan blade are located in said air flow passageway.

12. The apparatus according to claim 10 wherein said air flow passageway is in fluid communication with said interior space of said housing at said air intake vent and said air exhaust vent.

13. The apparatus according to claim 10 wherein said cradle comprises:

a pair of vertically-spaced rings sized to snugly receive the refrigerant bottle therein;

a plurality of columns connecting said vertically-spaced rings together;

a platform member secured to the lower one of said vertically-spaced rings for supporting the refrigerant bottle at a fixed height above the bottom of said interior space of said housing; and, a plurality of fingers extending outwardly from the upper one of said vertically-spaced rings for spacing the upper one of said vertically-spaced rings from the walls of said housing.

14. The apparatus according to claim 10 further comprising a switch for manually opening said electrical circuit to disconnect said electrical resistance heater and said electric motor from the power source.

15. The apparatus according to claim 10 further comprising a first sealing element secured around the periphery of said central aperture in said lid for engaging the refrigerant bottle and preventing the loss of heated air through said central aperture.

16. The apparatus according to claim 10 further comprising a second sealing element secured around the periphery of said lid for engaging said housing and preventing the loss of heated air through said opening in said housing.

17. An apparatus for warming a refrigerant bottle having a valve stem extending therefrom, said apparatus comprising:

a housing having an interior space adapted to receive the refrigerant bottle and an opening providing access to said interior space;

a cradle positioned within said interior space of said housing for receiving the refrigerant bottle therein and spacing the refrigerant bottle from the walls of said housing in order to facilitate air circulation through said interior space;

a lid removably covering said opening in said housing, said lid having a central aperture for the passage of the valve stem of the refrigerant bottle, said lid also having an air intake vent and an air exhaust vent adjacent said central aperture;

an air flow passageway connecting said air intake vent with said air exhaust vent for circulating air to and from said interior space of said housing, said air flow passageway being in fluid communication with said interior space of said housing at said air intake vent and said air exhaust vent;

an electrical resistance heater positioned within said air flow passageway for elevating the temperature of air brought into contact therewith;

a fan blade positioned within said air flow passageway adjacent said electrical resistance heater;

an electric motor having a rotatable shaft connected to said fan blade for rotating same so as to impel air through said passageway from said air intake vent to said air exhaust vent and past said electrical resistance heater;

a switch for manually opening the electrical circuit to said electrical resistance heater and said electric motor; and, a thermostat positioned in said housing for deenergizing said electrical resistance heater when the air within said interior space reaches a predetermined temperature; and, an electrical circuit connecting said electrical resistance heater, said electric motor and said thermostat with a source of electrical current, said electrical circuit having a switch for manually disconnecting said electrical resistance heater and said electric motor from the source of electrical current.

* * * * *